US008693919B2

(12) United States Patent
Shiraki

(10) Patent No.: US 8,693,919 B2
(45) Date of Patent: Apr. 8, 2014

(54) IMAGE FORMING APPARATUS

(75) Inventor: Masatoshi Shiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 264 days.

(21) Appl. No.: 13/070,556

(22) Filed: Mar. 24, 2011

(65) Prior Publication Data

US 2011/0236071 A1 Sep. 29, 2011

(30) Foreign Application Priority Data

Mar. 24, 2010 (JP) ..... 2010-068571

(51) Int. Cl.
*G03G 15/30* (2006.01)

(52) U.S. Cl.
USPC ..... 399/149; 399/150; 399/361; 399/364; 399/401

(58) Field of Classification Search
USPC ..... 399/149, 150, 361, 364, 401
See application file for complete search history.

(56) References Cited

U.S. PATENT DOCUMENTS 5,587,774 A * 12/1996 Nagahara et al. ..... 399/176
6,449,444 B1 * 9/2002 Tanaka ..... 399/66
2007/0110482 A1 5/2007 Kazaki et al.

FOREIGN PATENT DOCUMENTS

JP 2000-313568 11/2000
JP 2006-330295 12/2006
JP 2007-140062 6/2007

* cited by examiner

*Primary Examiner* — Ryan Walsh
(74) *Attorney, Agent, or Firm* — Banner & Witcoff, Ltd.

(57) ABSTRACT

An image forming apparatus comprising: a photosensitive drum having a circumferential surface, on which a developer image is formed; a transfer member configured to transfer the developer image from the circumferential surface of the photosensitive drum to a recording medium conveyed along the conveying path in a conveying direction; a collecting member; and a motor capable of performing a forward rotation and a reverse rotation; wherein, based on a timing when a portion of the circumferential surface of the photosensitive drum faces an upstream side edge of the developer image on the recording medium in the conveying direction, a time elapsed until the motor is stopped to change from performing the forward rotation to the reverse rotation is longer than a time elapsed until the portion of the circumferential surface of the photosensitive drum that faced the upstream side edge of the developer image faces the collecting member.

8 Claims, 6 Drawing Sheets

IMAGE FORMING APPARATUS

CROSS-REFERENCE TO RELATED APPLICATIONS

This application claims priority from Japanese Patent Application No. 2010-068571 filed on Mar. 24, 2010, the entire contents of which are incorporated herein by reference.

TECHNICAL FIELD

Aspects of the present invention relates to an electrophotographic image forming apparatus.

BACKGROUND

In an electrophotographic image forming apparatus, accompanied by rotation of a photosensitive drum, an electrostatic latent image is formed on a circumferential surface of the photosensitive drum, and then, toner is supplied from a development roller onto the circumferential surface of the photosensitive drum. As a result, the electrostatic latent image is developed into a toner image. The toner image is carried by the circumferential surface of the photosensitive drum. In a downstream side of the development roller in a rotation direction of the photosensitive drum, a transfer roller is disposed facing the photosensitive drum. Accompanied by the rotation of the photosensitive drum, a sheet is supplied between the photosensitive drum and the transfer roller at a timing that the toner image carried on the circumferential surface of the photosensitive drum faces the circumferential surface of the transfer roller. Due to function of a bias applied to the transfer roller, the toner image is transferred from the circumferential surface of the photosensitive drum onto the sheet, such that image (toner image) forming on the sheet is achieved.

The image forming apparatus provides a so-called double-side mode, in which after an image is formed on one face of a sheet, faces of the sheet is reversed and conveyed such that an image is formed on another face of the sheet.

The image forming apparatus having the double-side mode includes, for example, a main conveying path for conveying the sheet through an image forming section having the photosensitive drum to an discharge port, and a sub conveying path for reversing the faces of the sheet, on which an image has been formed by the image forming section, and conveying the sheet to the image forming section.

Each roller provided in the photosensitive drum, the main conveying path, and the sub conveying path is rotated, for example, based on an output of a single reversible motor. That is, based on the output of the reversible motor performing forward rotation, the photosensitive and each roller of the main conveying path is rotated. As a result, the sheet is conveyed through the main conveying path, and the toner image from the photosensitive drum is transferred onto the sheet. Meanwhile, based on output of the reversible motor performing reverse rotation, each roller of the sub conveying path is rotated, and the sheet is conveyed through the sub conveying path. In view of restraining deterioration of the photosensitive drum, for example, a clutch is installed between the reversible motor and the photosensitive drum, so that when the reversible motor performs the reverse rotation, connection between the reversible motor and the photosensitive drum is disconnected by the clutch.

SUMMARY

While a sheet is being conveyed along the sub conveying path, a sheet is not conveyed along the main conveying path.

As such, even if the output of the reversible motor performing the reverse rotation is transmitted to the photosensitive drum and each roller of the main conveying path, it does not affect conveying of the sheet. Therefore, by not installing a clutch so that the output of the reversible motor performing the reverse rotation is also transmitted to the photosensitive drum, configuration of the image forming apparatus can be simplified.

However, in the above-described configuration, when the toner adhered on the circumferential surface of the photosensitive drum faces the transfer roller, by the rotation of the photosensitive drum, the toner may be transferred from the circumferential surface of the photosensitive drum onto the circumferential surface of the transfer roller. If toner is adhered on the transfer roller, the toner will be transferred from the transfer roller to the sheet when the sheet is conveyed along the main conveying path, such that the sheet becomes dirty.

Accordingly, it is an aspect of the present invention is to provide an image forming apparatus, which is capable of preventing transferring of a toner from a circumferential surface of a photosensitive drum to a circumferential surface of a transfer roller.

According to an aspect of the present invention, there is provided an image forming apparatus comprising: a photosensitive drum having a circumferential surface, on which a developer image is formed; a transfer member that faces the circumferential surface of the photosensitive drum so as to form a conveying path therebetween, the transfer member configured to transfer the developer image from the circumferential surface of the photosensitive drum to a recording medium conveyed along the conveying path in a conveying direction; a collecting member of a roller type, facing the circumferential surface of the photosensitive drum, the collecting member configured to collect any developer remaining on the circumferential surface of the photosensitive drum after the developer image is transferred from the circumferential surface of the photosensitive drum to the recording medium; a motor capable of performing a forward rotation and a reverse rotation; a driving unit configured to rotate the photosensitive drum in a forward direction based on an output of the motor performing the forward rotation, so that a movement direction of the circumferential surface of the photosensitive drum and the conveying direction of the recording medium are the same, and to rotate the photosensitive drum in a direction opposite to the forward direction based on an output of the motor performing the reverse rotation; a forward conveying unit configured to convey the recording medium along the conveying path based on the output of the motor performing the forward rotation; and a reverse conveying unit configured to convey the recording medium, having the developer image transferred on one face thereof, along a reverse conveying path based on the output of the motor performing the reverse rotation, and to feed the recording medium to the conveying path so that another face of the recording medium faces the circumferential surface of the photosensitive drum, wherein, based on a timing when a portion of the circumferential surface of the photosensitive drum faces an upstream side edge of the developer image on the recording medium in the conveying direction, a time elapsed until the motor is stopped to change from performing the forward rotation to the reverse rotation is longer than a time elapsed until the portion of the circumferential surface of the photosensitive drum that faced the upstream side edge of the developer image faces the collecting member.

According to another aspect of the present invention, there is provided an image forming apparatus comprising: a photosensitive drum having a circumferential surface, on which a developer image is formed; a transfer member that faces the circumferential surface of the photosensitive drum, the transfer member configured to transfer the developer image from the circumferential surface of the photosensitive drum to a predetermined object moving in a moving direction; a collecting member, facing the circumferential surface of the photosensitive drum, the collecting member configured to collect any developer remaining on the circumferential surface of the photosensitive drum after the developer image is transferred from the circumferential surface of the photosensitive drum to the predetermined object; a motor capable of performing a forward rotation and a reverse rotation; and a driving unit configured to rotate the photosensitive drum in a forward direction based on an output of the motor performing the forward rotation, so that a movement direction of the circumferential surface of the photosensitive drum and the moving direction of the predetermined object are the same, and to rotate the photosensitive drum in a direction opposite to the forward direction based on an output of the motor performing the reverse rotation, wherein, based on a timing when a portion of the circumferential surface of the photosensitive drum faces an upstream side edge of the developer image on the predetermined object in the moving direction, a time elapsed until the motor is stopped to change from performing the forward rotation to the reverse rotation is longer than a time elapsed until the portion of the circumferential surface of the photosensitive drum that faced the upstream edge of the developer image faces the collecting member.

DETAILED DESCRIPTION

Hereinafter, exemplary embodiments of the present invention will be described in detail with reference to the accompanied drawings.

1. Entire Configuration of the Printer

Figure 1:
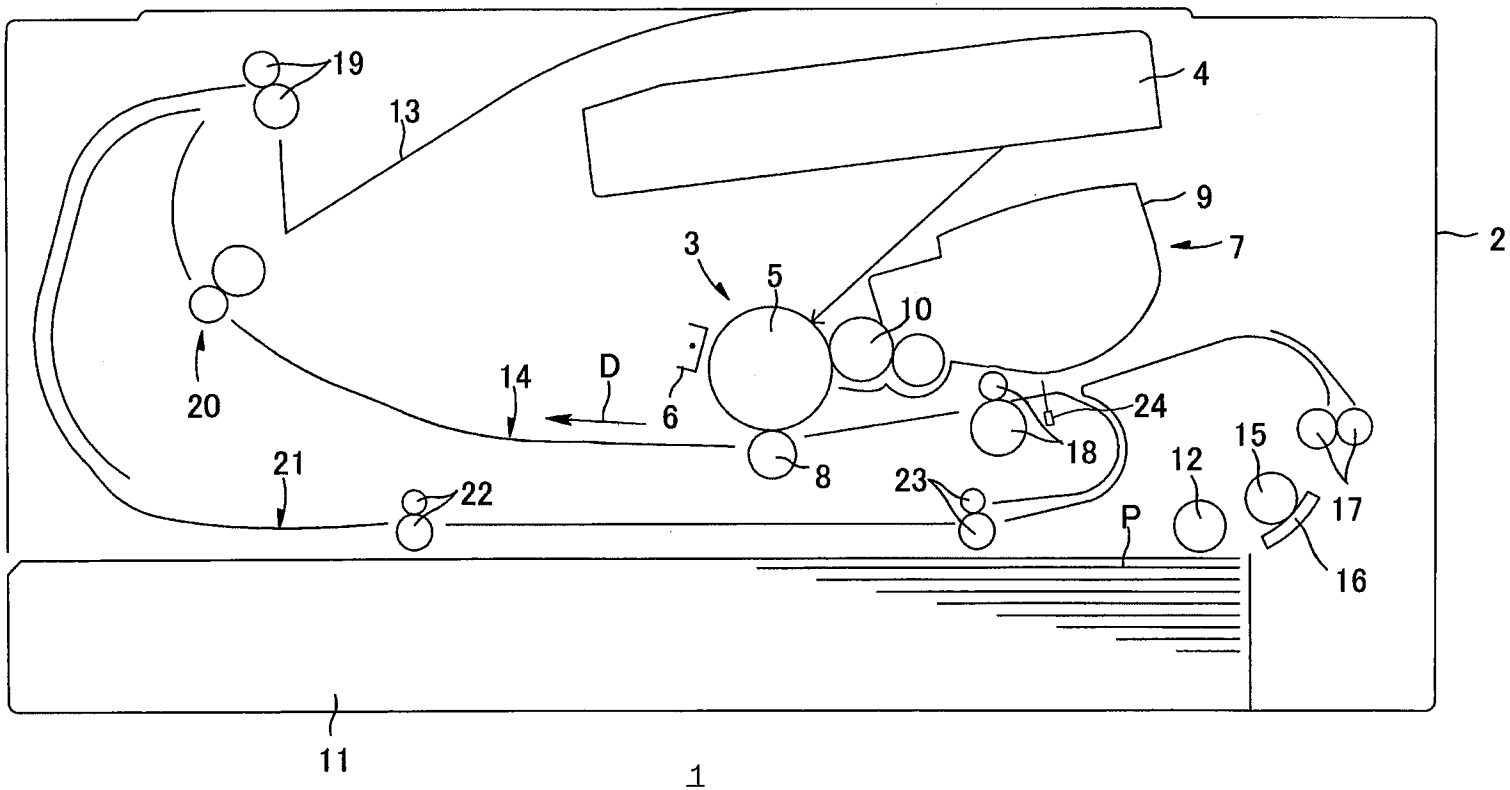
FIG. 1 is a cross-sectional view showing a printer according to an exemplary embodiment of the present invention.

As shown in FIG. 1, a printer 1, which is an example of an image forming apparatus, includes a body casing 2. A process section 3 is located at the central portion of the body casing 2. An exposure unit 4 having a laser and the like is located upper to the process section 3.

The process section 3 includes a photosensitive drum 5, a charger 6, a developer 7 and a transfer roller 8 which is an example of a transfer member.

The photosensitive drum 5 is capable of rotating around an axis extending in a direction perpendicular to the sheet surface of FIG. 1.

The charger 6 is a scorotron type charger and faces a circumferential surface of the photosensitive drum 5 with a space therebetween.

The developer 7 includes a development housing 9 for containing toner, and a development roller 10 rotatably supported by the developing housing 9, which is an example of a collecting member. The main component of the toner contained in the development housing 9 is ester resin. A portion of a circumferential surface of the development roller 10 is exposed from the development housing 9. The developer 7 is located such that the circumferential surface of the development roller 10 contacts the circumferential surface of the photosensitive drum 5. The developer includes the development roller as an example of the collecting member containing toner and being rotatably supported.

The transfer roller 8 is located at a bottom portion of the photosensitive drum 5 so as to be rotatable around an axis parallel with the rotation axis of the photosensitive drum 5. The circumferential surface of the transfer roller 8 contacts the circumferential surface of the photosensitive drum 5.

Upon image forming, the photosensitive drum 5 is rotated in a clockwise direction of FIG. 1 at a constant speed. Accompanied by the rotation of the photosensitive drum 5, the circumferential surface of the photosensitive drum 5 is uniformly positively charged by discharge from the charger 6. Meanwhile, based on image data received from a personal computer (not shown) connected to the printer 1, a laser beam is emitted from the exposure unit 4. The laser beam passes between the charger 6 and the developer 7, and is irradiated onto the circumferential surface of the uniformly positively charged photosensitive drum 5. As a result, the circumferential surface of the photosensitive drum 5 is selectively exposed, and charges are selectively removed from the exposed portions, so that an electrostatic latent image is formed on the circumferential surface of the photosensitive drum 5. When the electrostatic latent image faces the development roller 10 by the rotation of the photosensitive drum 5, positively charged toner is supplied from the development roller 10 to the electrostatic latent image. As a result, a toner image is formed on the circumferential surface of the photosensitive drum 5.

A sheet feed cassette 11 for containing sheets P, which is an example of a recording medium, is located at the bottom portion of the body casing 2. A pick up roller 12 for delivering the sheets from the sheet feed cassette 11 is located upper to the sheet feed cassette 11.

A conveying path 14, which has an S shape when the boding casing 2 is viewed from its side, is formed inside the body casing 2. The conveying path 14 starts from the sheet feed cassette 11, passes between the photosensitive drum 5 and the transfer roller 8, and reaches a sheet discharge tray 13 formed on a top surface of the body casing 2. A separating roller 15 and a separating pad 16, which face each other, and a pair of sheet feed rollers 17, a pair of resistor rollers 18, and a pair of sheet discharge rollers 19 are located to the conveying path 14.

The sheets P delivered from the sheet feed cassette 11 pass between the separating roller 15 and the separating pad 16 one at a time. Subsequently, the sheet P is conveyed by the sheet feed rollers 17 toward the resistor rollers 18.

A resistor sensor 24 is located near an upstream side of the resistor roller 18, in a conveying direction of the sheet P conveyed along the conveying path 14. The resistor sensor 24 includes an actuator extending toward the conveying path 14. When the sheet P delivered from the feed rollers 17 contacts the actuator of the resistor sensor 24, an ON signal is inputted from the resistor sensor 24 to a micro computer 35 (see FIG. 2), which will be described later.

The sheet P that arrived to the resistor rollers 18 is conveyed by the resistor rollers 18 toward between the photosensitive drum 5 and the transfer roller 8.

The toner image on the circumferential surface of the photosensitive drum 5 is transferred onto the sheet P when the toner image faces the sheet P passing between the photosensitive drum 5 and the transfer roller 8 by the rotation of the photosensitive drum 5.

A fixing unit 20 is located to the conveying path 14 at a downstream side of the transfer roller 8 in the conveying direction of the sheet P. The sheet P to which the toner image has been transferred is conveyed along the conveying path 14, and passes the fixing unit 20. At the fixing unit 20, the toner image is changed into an image by heat and pressure applied, and fixed onto the sheet P.

The printer 1 employs a cleanerless method, in which any toner remaining on the circumferential surface of the photosensitive drum 5, after the toner image has been transferred onto the sheet P, is pulled toward the circumferential surface of the development roller 10 and collected when the toner faces the development roller 10, by the rotation of the photosensitive drum 5.

The printer 1 provides a one-side mode for forming an image (toner image) on one face of the sheet P, and a double-side mode for forming an image on one face of the sheet P and then forming an image on another face of the sheet P.

In the one-side mode, the sheet P having an image formed on the one face is discharged from the sheet discharge tray 13 by the sheet discharge rollers 19.

Meanwhile, in order to realize the double-side mode, a reverse conveying path 21 is formed inside the body casing 2. The reverse conveying path 21 extends from a portion near the sheet discharge rollers 19 through between the conveying path 14 and the sheet feed cassette 11, and is connected to a portion between the sheet feed rollers 17 and the resistor rollers 18 on the reverse conveying path 14. A pair of first reverse convey rollers 22 and a pair of second reverse convey rollers 23 are located to the reverse conveying path 21.

In the double-side mode, after an image is formed on the one face of the sheet P, the sheet P is not discharged from the sheet discharge tray 13, and is conveyed to the reverse conveying path 21. Specifically, the sheet P is switched back by the sheet discharge rollers 19 and conveyed to the reverse conveying path 21. The sheet P is conveyed to the reverse conveying path 21 by the first reverse convey rollers 22 and the second reverse convey rollers 23. Then, the faces of the sheet P is reversed. Therefore, the sheet P is transferred to the conveying path 14 such that the other face of the sheet P, on which an image is not formed, faces the circumferential surface of the photosensitive drum 5. An image is formed on the other face of the sheet P, so as to obtain a sheet having an image formed on both faces thereof

2. Electrical Configuration of the Printer

Figure 2:
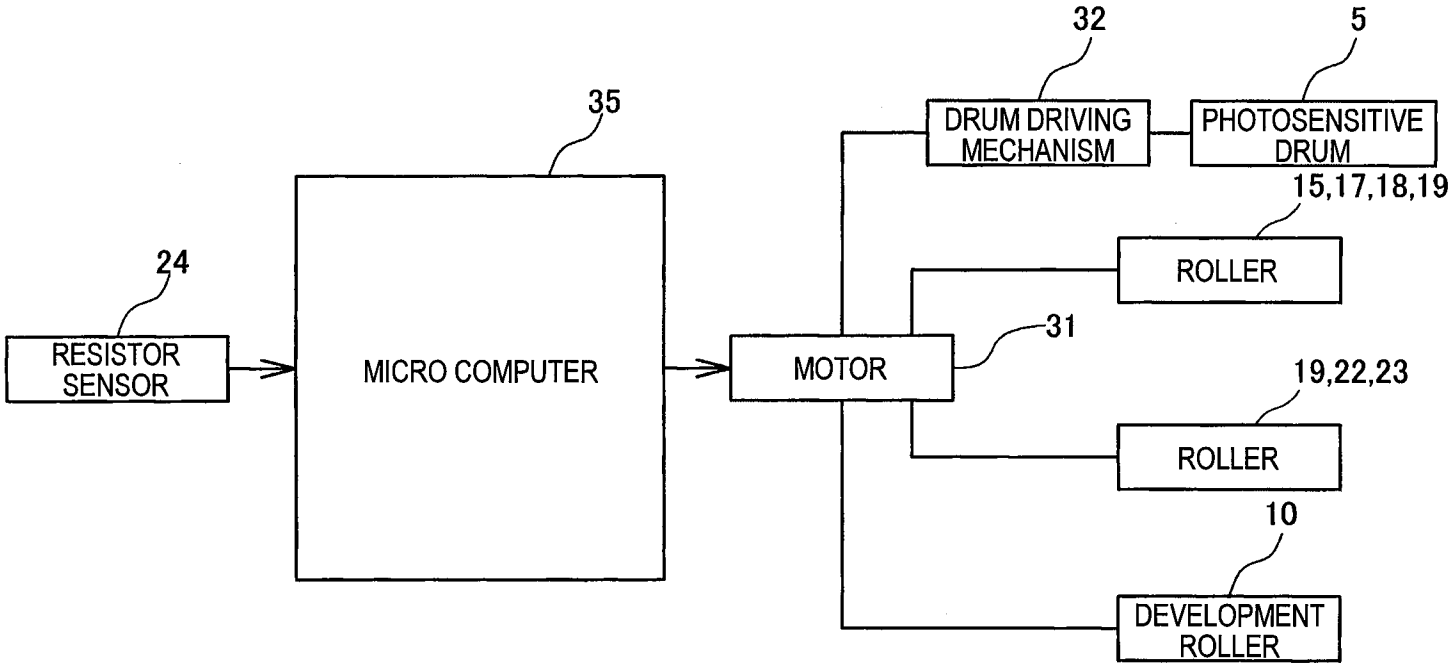
FIG. 2 is a block diagram showing an electrical configuration of the printer.

As shown in FIG. 2, the printer 1 includes a motor 31. The motor 31 is capable of performing a forward rotation and a reverse rotation.

The printer 1 includes a drum driving mechanism 32 as one example of a driving unit. The drum driving mechanism 32 includes a gear, and others. Output of the motor 31 is delivered to the photosensitive drum 5 through the drum driving mechanism 32.

An output of the motor 31 performing forward rotation forwardly rotates the photosensitive drum 5 at a constant speed in a rotation direction when an electrostatic latent image is being developed (clockwise direction in FIG. 1). Further, the separating roller 15, the sheet feed rollers 17, the resistor rollers 18, and the sheet discharge rollers 19, which are an example of a forward conveying unit on the conveying path 14, are rotated based on the output of the motor 31 performing the forward rotation. The sheet P is conveyed along the conveying path 14 as a result of the rotation of the separating roller 15, the sheet feed rollers 17, the resistor rollers 18, and the sheet discharge rollers 19.

Meanwhile, an output of the motor 31 performing reverse rotation reversely rotates the photosensitive drum 5 at a constant speed in a direction opposite to that of the forward rotation (counterclockwise direction in FIG. 1). Further, the sheet discharge rollers 19, and the first reverse convey rollers 22 and the second reverse convey rollers 23 on the reverse conveying path 21, which are an example of a reverse conveying unit, are rotated based on the output of the motor 31 performing the reverse rotation. The sheet P is conveyed along the reverse conveying path 21 as a result of the rotation of the first reverse convey rollers 22 and the second reverse convey rollers 23. A rotation direction of the sheet discharge rollers 19 based on the output of the motor 31 performing reverse direction is reverse to a rotation direction of the discharge rollers 19 based on the output of the motor 31 performing forward direction.

The printer 1 includes the micro computer 35. The micro computer 35 includes a Central Processing Unit (CPU), a memory, etc., as hardware configuration. The motor 31 is connected to the micro computer 35 as an object to be controlled. A signal from the resistor sensor 24 is input to the micro computer 35.

3. Performance of Each Section Upon Image Forming

When an image is formed on both faces of the sheet P, the motor 31 is first forwardly rotated, and the photosensitive drum 5 is forwardly rotated. A positive development bias (for example, +300 V) is applied to the development roller 10. A negative transfer bias (for example, −1000 V) is applied to the transfer roller 8. Meanwhile, for example, a bias of +100 V is applied to an exposed portion on the surface of the photosensitive drum 5, and for example, a bias of +800 V is applied to a remaining portion.

The separating roller 15, the sheet feed rollers 17, the resistor rollers 18, and the sheet discharge rollers 19 are rotated based on the forward rotation of the motor 31. As a result of the rotation of the separating roller 15 and the sheet feed rollers 17, the sheet P is delivered from the sheet feed cassette 11 to the conveying path 14. The sheet P on the conveying path 14 is conveyed toward the resistor roller 18. The front end (the downstream end in the conveying direction D) of the sheet P comes in contact with the actuator of the resistor sensor 24 before arriving at the resistor roller 18. As a result, an ON signal is output from the resistor sensor 24 (T1).

Subsequently, the sheet P is conveyed by the resistor rollers 18. The front end of the sheet P arrives at a region where the photosensitive drum 5 and the transfer roller 8 face each other (hereinafter referred to as a "facing region") (T2).

A portion of the sheet P within a predetermined width from an edge thereof at the upstream side and a portion of the sheet P within a predetermined width from an edge thereof at the downstream side, in the conveying direction D along the conveying path 14, are respectively set as margin regions. A region between the margin regions is an image forming region, on which an image (toner image) is formed.

When the front end of the sheet P arrives at the facing region, and the sheet P is conveyed by a length of the margin region at the downstream side in the conveying direction D, a downstream side edge of the image forming region of the sheet P, in the conveying direction D, arrives at the facing region. Then, the image forming region of the sheet P passes the facing region. While the image forming region of the sheet P passes the facing region, the toner image formed on the circumferential surface of the photosensitive drum 5 faces the facing region in series. When the toner image faces the facing region, due to the function of the transfer bias applied to the transfer roller 8, the toner image is transferred from the circumferential surface of the photosensitive drum 5 onto the sheet P between the circumferential surface of the photosensitive drum 5 and the transfer roller 8.

A length of the toner image formed on the circumferential surface of the photosensitive drum 5 in the rotation direction of the photosensitive drum 5 (a length in a sub scanning direction) varies, for example, depending on image data that the printer 1 receives from an external personal computer. Before an upstream side edge of the image forming region of the sheet P, in the conveying direction D, passes the facing region, the upstream side edge of the toner image formed on the circumferential surface of the photosensitive drum 5, in a rotation direction of the photosensitive drum 5, arrives at the facing region (T3). Time elapsed from when the downstream side edge of the sheet P in the conveying direction arrives at the resistor sensor 24 until the upstream side edge of the toner image arrives at the facing region can be calculated based on a length of the margin region of the sheet P at the downstream side of the conveying direction D and image data received by the printer 1.

As the sheet P is further conveyed, the upstream side edge of the image forming region of the sheet P, in the conveying direction D, passes the facing region (T5). Subsequently, the upstream side edge of the sheet P, in the conveying direction D, passes the facing region (T6).

When the upstream side edge of the sheet P, in the conveying direction D, is apart from the actuator of the resistor sensor 24, the output signal of the resistor sensor 24 is changed from the ON signal to an OFF signal (T4).

The sheet P that passed the facing region is conveyed along the conveying path 14 toward the sheet discharge rollers 19. When the paper P passes the fixing unit 20, image formation on the one face of the paper P is completed.

After the toner image is transferred onto the sheet P, a small amount of toner remains on the circumferential surface of the photosensitive drum 5. When the portion of the circumferential surface of the photosensitive drum 5, on which the toner image has been formed, faces the development roller 10, by the rotation of the photosensitive drum 5, the toner remaining on the circumferential surface of the photosensitive drum 5 is collected by the circumferential surface of the development roller 10, due to an difference in electric potential between the development roller 10 and the photosensitive drum 5. As a result, the toner remaining on the portion of the circumferential surface of the photosensitive drum 5, on which the toner image has been formed, is sequentially removed from the downstream end in the rotation direction when facing the development roller 10.

When a portion of the circumferential surface of the photosensitive drum 5, on which the rear end of the toner image has been formed (that is, the portion facing the transfer roller 8 at T3), faces the development roller 10 (T7), the toner is removed from the entire region of the circumferential surface of the photosensitive drum 5.

Subsequently, the motor 31 is temporally stopped, and reversely rotated (T8). That is, the motor 31 is temporally stopped and reversely rotated after the portion of the circumferential surface of the photosensitive drum 5, on which the rear end of the toner image has been formed, faces the development roller 10

Next, the sheet P is conveyed along the reverse conveying path 21. Then, the sheet P is transferred from the reverse conveying path 21 to the conveying path 14. In the same manner as forming the image on the one face of the sheet P, an image is formed on the other face of the sheet P.

4. Effects

As described above, based on the timing (T3) that the rear end of the toner image formed on the image forming region passes the facing region, a time elapsed until the motor 31 is stopped for performing the reverse rotation (T3 to T8) is longer than a time elapsed until the portion of the circumferential surface of the photosensitive drum 5, on which the rear end of the toner image has been formed, faces the development roller 10 (T3 to T7). As such, even if the photosensitive drum 5 is reversely rotated based on the motor 31 performing reverse rotation, and the portion of the circumferential surface of the photosensitive drum 5, on which the toner image has been formed, faces the transfer roller 8, since the toner image has been removed from the portion, the toner transferring from the circumferential surface of the photosensitive drum 5 to the circumferential surface of the transfer roller 8 can be prevented.

Further, the printer 1 employs the cleanerless method. When the motor 31 is performing forward rotation, the toner remaining on the circumferential surface of the photosensitive drum 5 after the toner image is transferred on the sheet P is collected by the development roller 10. As such, it is unnecessary to individually provide a cleaning equipment (a cleaning brush, a cleaning roller, or others) for collecting the toner remaining on the circumferential surface of the photosensitive drum 5. Therefore, the configuration of the printer 1 can be simplified. Moreover, if no cleaning equipment is provided, toner transfer from the cleaning equipment to the circumferential surface of the photosensitive drum 5 does not occur when the motor 31 performs the reverse rotation. Accordingly, an amount of toner attached to the circumferential surface of the photosensitive drum 5 can be reduced, so that toner transfer from the circumferential surface of the photosensitive drum 5 to the circumferential surface of the transfer roller 8 can be further prevented.

5. Second Exemplary Embodiment

Figure 4:
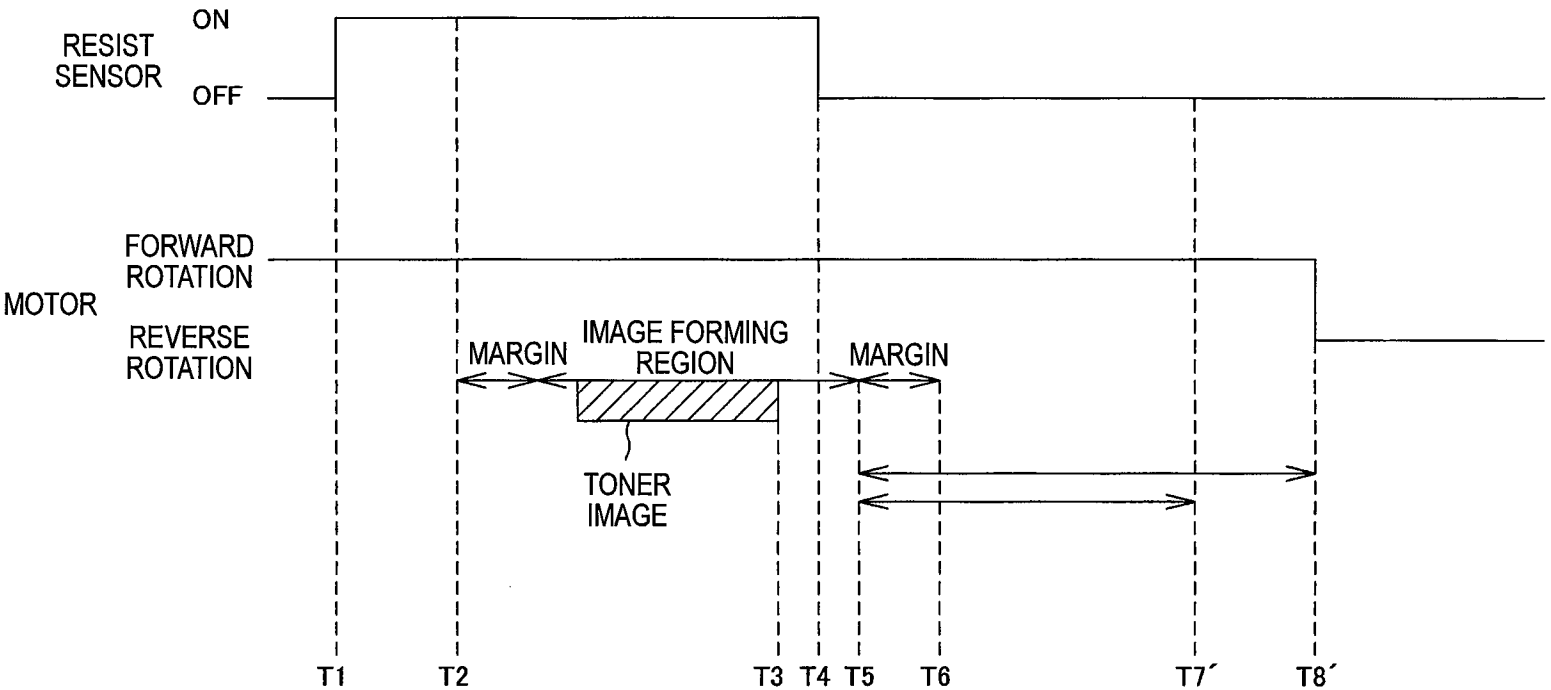
FIG. 4 is a timing chart for explaining operation of each section upon image forming according to a second exemplary embodiment of the present invention.

In the timing chart shown in FIG. 4, based on the timing (T5) that the upstream side edge of the image forming region of the sheet P, in the conveying direction D, passes the facing region, a time elapsed until the motor 31 is stopped for performing the reverse rotation (T5 to T8') is longer than a time elapsed until the portion of the circumferential surface of the photosensitive drum 5, on which the rear end of the toner image has been formed, faces the development roller 10 (T5 to T7').

Time elapsed, since the upstream side edge of the toner image formed on the circumferential surface of the photosensitive drum 5, in the rotation direction of the photosensitive drum 5, passes the facing region (T3), until the upstream side edge of the image forming region of the sheet P, in the conveying direction D, passes the facing region (T5), is constant (T3 to T5). As such, in the timing chart shown in FIG. 4, even based on the timing that the upstream side edge of the toner image on the circumferential surface of the photosensitive drum 5, in the rotation direction of the photosensitive drum 5, passes the facing region (T3), the relationship of (T3−T7'<T3−T8') is established.

Accordingly, the upstream side end of the toner image can unfailingly face the development roller 10 before the motor 31 is stopped for performing the reverse rotation, so that toner transfer from the circumferential surface of the photosensitive drum 5 to the circumferential surface of the transfer roller 8 can be prevented.

6. Third Exemplary Embodiment

Figure 5:
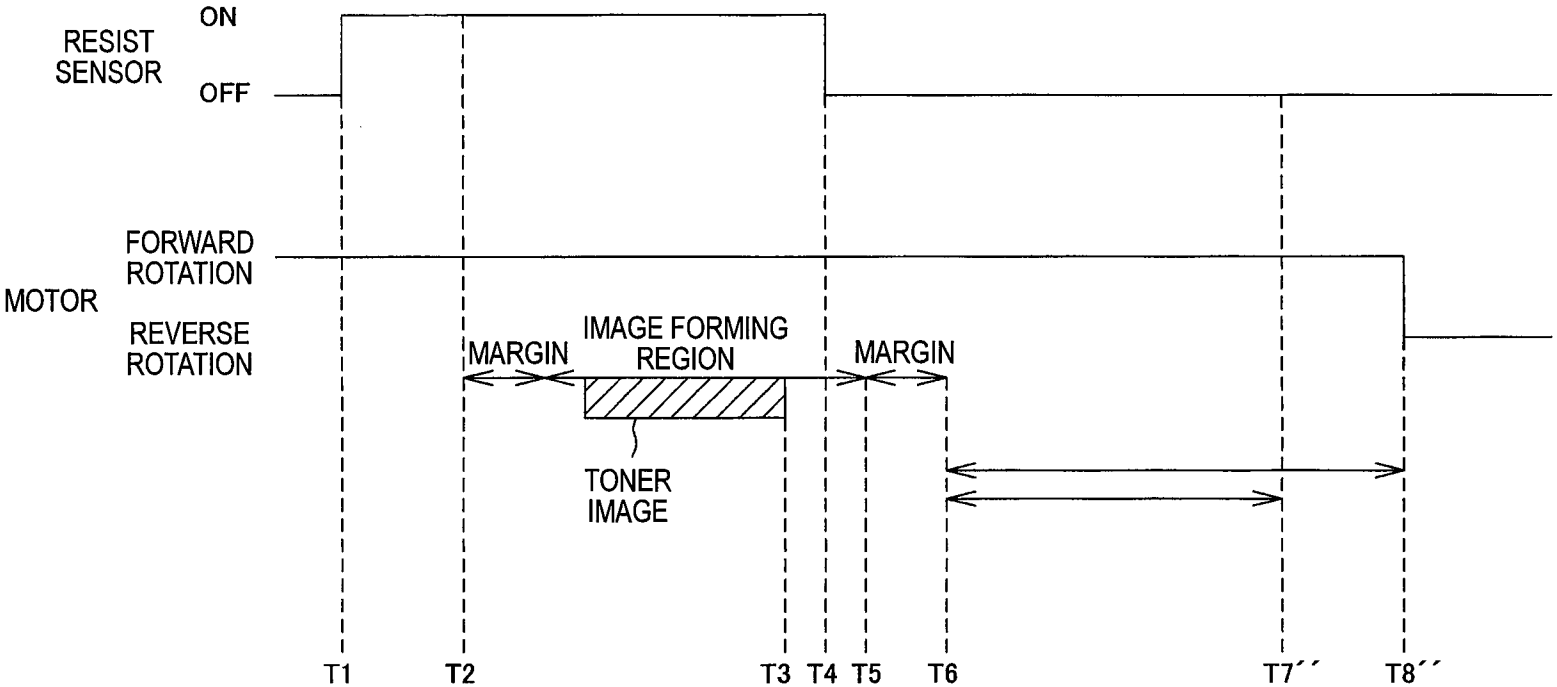
FIG. 5 is a timing chart for explaining performance of each section upon image forming according to a third exemplary embodiment of the present invention.

In the timing chart shown in FIG. 5, based on the timing (T6) that the upstream side edge of the sheet P, in the conveying direction D, passes the facing region, a time elapsed until the motor 31 is stopped for performing the reverse rotation (T6 to T8'), is longer than a time elapsed until the portion of the circumferential surface of the photosensitive drum 5, on which the rear end of the toner image has been formed, faces the development roller 10 (T6 to T7").

Time elapsed, since the upstream side edge of the toner image formed on the circumferential surface of the photosensitive drum 5, in the rotation direction of the photosensitive drum 5, passes the facing region (T3), until the upstream side edge of the sheet P in the conveying direction D passes the facing region (T6), is constant (T3 to T6). As such, in the timing chart shown in FIG. 5, even based on the timing that the upstream side edge of the toner image on the circumferential surface of the photosensitive drum 5, in the rotation direction of the photosensitive drum 5, passes the facing region (T3), the relationship of (T3−T7"<T3−T8") is established.

Accordingly, the upstream side end of the toner image can unfailingly face the development roller 10 before the motor 31 is stopped for performing the reverse rotation, so that toner transfer from the circumferential surface of the photosensitive drum 5 to the circumferential surface of the transfer roller 8 can be prevented.

7. Fourth Exemplary Embodiment

Figure 6:
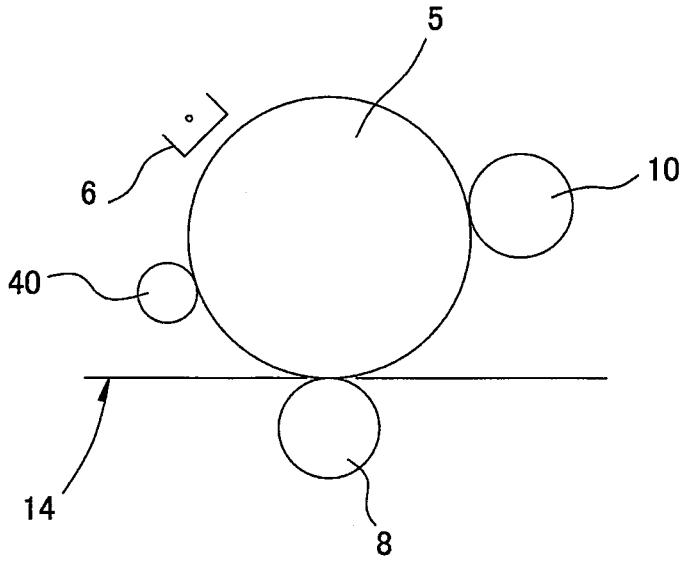
FIG. 6 is an enlarged view of a process section according to a fourth exemplary embodiment of the present invention.

As shown in FIG. 6, a cleaning roller 40, which is located in a downstream side of the transfer roller 8 and an upstream side of the development roller 10, in the rotation direction of the photosensitive drum 5 (the clockwise direction in FIG. 6), may be employed as an example of the collecting member.

The cleaning roller 40 is a roller type member, which can be rotated around an axis parallel with the rotation axis of the photosensitive drum 5.

Figure 3:
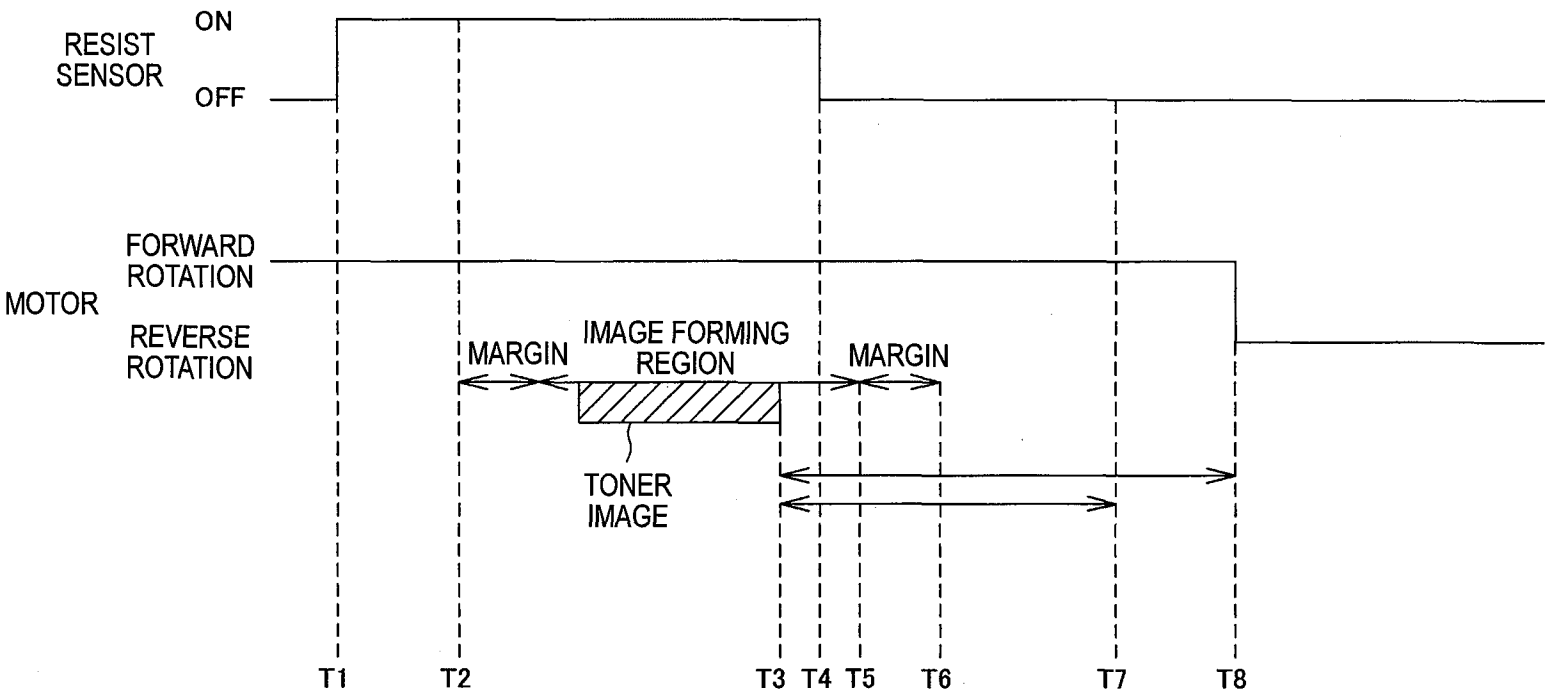
FIG. 3 is a timing chart for explaining operation of each section upon image forming.

When the motor 31 is performing forward rotation, after the toner image is transferred from the photosensitive drum 5 onto the sheet P, the toner remaining on the circumferential surface of the photosensitive drum 5 is collected by the circumferential surface of the cleaning roller 40, when the toner faces the cleaning roller 40. In this case, as shown in FIG. 3, based on the timing that the rear end of the toner image formed on the circumferential surface of the photosensitive drum 5 passes the facing region (T3), a time elapsed until the motor 31 starts performing the reverse rotation (T8) is longer than a time elapsed until the portion of the circumferential surface of the photosensitive drum 5, on which the rear end of the toner image has been formed, faces the cleaning roller 40. Accordingly, the upstream side end of the toner image can unfailingly face the development roller 10 before the motor 31 is stopped for performing the reverse rotation, so that toner transfer from the circumferential surface of the photosensitive drum 5 to the circumferential surface of the transfer roller 8 can be prevented.

8. Modified Embodiments

Four exemplary embodiments of the present invention have been described. However, the present invention also includes other various embodiments. The examples of the other various embodiments are described hereinafter.

For example, in the first, second and third exemplary embodiments, it was defined that, based on the timing that the upstream side ends of the toner image, the image forming region, and the sheet P respectively pass the facing region, time elapsed until the motor 31 is stopped for performing the reverse rotation is longer than the time elapsed until the portion of the circumferential surface of the photosensitive drum 5, on which the rear end of the toner image has been formed, faces the development roller 10. However, it may be defined that, the time elapsed until the motor 31 is stopped for performing the reverse rotation is longer than a time elapsed until the portion of the circumferential surface of the photosensitive drum 5, which faced the upstream side edge of the image forming region, faces the development roller 10, or a time elapsed until the portion of the circumferential surface of the photosensitive drum 5, which faced the upstream side edge of the sheet P, faces the development roller 10.

Even in this case, the portion of the circumferential surface of the photosensitive drum 5, on which the rear end of the toner image has been formed, can face the development roller 10 earlier than the portion of the circumferential surface of the photosensitive drum 5 which faces the upstream side edge of the image forming region and the portion of the circumferential surface of the photosensitive drum 5 which faces the upstream side edge of the sheet P. Thus, toner transfer from the circumferential surface of the photosensitive drum 5 to the circumferential surface of the transfer roller 8 can be prevented.

The present invention is not limited to a monochrome printer, and may be applied to a color printer.

What is claimed is:

1. An image forming apparatus comprising:

a photosensitive drum having a circumferential surface and configured to hold a developer image on the circumferential surface;

a transfer member that faces the circumferential surface of the photosensitive drum so as to form a conveying path therebetween, the transfer member configured to transfer the developer image from the circumferential surface of the photosensitive drum to a recording medium conveyed along the conveying path in a conveying direction;

a collecting member of a roller type, facing the circumferential surface of the photosensitive drum, the collecting member configured to collect developer remaining on the circumferential surface of the photosensitive drum after the developer image is transferred from the circumferential surface of the photosensitive drum to the recording medium;

a driving mechanism coupled to the photosensitive drum and configured to rotate the photosensitive drum in a forward direction and in a reverse direction;

a motor configured to drive the driving mechanism such that the photosensitive drum rotates either in the forward direction or in the reverse direction;

a forward conveying mechanism for conveyance of the recording medium along the conveying path as the motor drives the driving mechanism such that the photosensitive drum rotates in the forward direction;

a reverse conveying mechanism for conveyance of the recording medium, having the developer image transferred on a first face thereof, along a reverse conveying path as the motor drives the driving mechanism such that the photosensitive drum rotates in the reverse direction, and for feeding the recording medium to the conveying path so that a second face opposite the first face of the recording medium faces the circumferential surface of the photosensitive drum; and a controller coupled to the motor, and configured to control the motor to drive the driving mechanism such that the photosensitive drum rotates in the forward direction until a particular portion of the circumferential surface of the photosensitive drum that faces a trailing edge of the developer image on the recording medium reaches the collecting member, and then to control the motor to drive the driving mechanism such that the photosensitive drum rotates in the reverse direction until the particular portion of the circumferential surface of the photosensitive drum faces the transfer member.

2. The image forming apparatus claimed in claim 1, further comprising a development roller for supplying the developer to the circumferential surface of the photosensitive drum, wherein the development roller is configured to function as the collecting member.

3. The image forming apparatus claimed in claim 1, further comprising a development roller for supplying the developer to the circumferential surface of the photosensitive drum, wherein the collecting member is disposed at a downstream side of the transfer member and an upstream side of the development roller, in the forward direction.

4. The image forming apparatus claimed in claim 1, further comprising a sensor, wherein an output of the sensor is used for identifying the recording medium, and wherein the sensor is located at an upstream side of the photosensitive drum in the conveying direction.

5. An image forming apparatus comprising:

a photosensitive drum having a circumferential surface and configured to hold a developer image on the circumferential surface;

a transfer member that faces the circumferential surface of the photosensitive drum, the transfer member configured to transfer the developer image from the circumferential surface of the photosensitive drum to a predetermined object moving in a moving direction;

a collecting member, facing the circumferential surface of the photosensitive drum, the collecting member configured to collect developer remaining on the circumferential surface of the photosensitive drum after the developer image is transferred from the circumferential surface of the photosensitive drum to the predetermined object;

a driving mechanism coupled to the photosensitive drum and configured to rotate the photosensitive drum in a forward direction and in a reverse direction; and a motor configured to drive the driving mechanism such that the photosensitive drum rotates either in the forward direction or in the reverse direction, wherein a controller is configured to control the motor to drive the driving mechanism such that the photosensitive drum rotates in the forward direction until a particular portion of the circumferential surface of the photosensitive drum that faces a trailing edge of the developer image on the predetermined object reaches the collecting member, and then to control the motor to drive the driving mechanism such that the photosensitive drum rotates in the reverse direction until the particular portion of the circumferential surface of the photosensitive drum faces the transfer member.

6. The image forming apparatus of claim 5, further comprising a development roller for supplying the developer to the circumferential surface of the photosensitive drum, wherein the development roller is configured to function as the collecting member.

7. The image forming apparatus of claim 5, further comprising a development roller for supplying the developer to the circumferential surface of the photosensitive drum, wherein the collecting member is disposed at a downstream side of the transfer member and an upstream side of the development roller, in the forward direction.

8. The image forming apparatus of claim 5, further comprising a sensor, wherein an output of the sensor is used for identifying the predetermined object, and wherein the sensor is located at an upstream side of the photosensitive drum in the moving direction.

* * * * *